US008256689B2

(12) United States Patent
Matsubara

(10) Patent No.: US 8,256,689 B2
(45) Date of Patent: Sep. 4, 2012

(54) AIR CONDITIONER AND INDOOR HUMIDITY CONTROL METHOD

(75) Inventor: Atsushi Matsubara, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 700 days.

(21) Appl. No.: 12/447,616

(22) PCT Filed: Nov. 7, 2007

(86) PCT No.: PCT/JP2007/071663

§ 371 (c)(1),
(2), (4) Date: Apr. 28, 2009

(87) PCT Pub. No.: WO2008/056717

PCT Pub. Date: May 15, 2008

(65) Prior Publication Data

US 2010/0072291 A1 Mar. 25, 2010

(30) Foreign Application Priority Data

Nov. 10, 2006 (JP) ..... 2006-306028

(51) Int. Cl.
*F24F 3/14* (2006.01)
*G01M 1/38* (2006.01)

(52) U.S. Cl. ..... 236/44 C; 700/276

(58) Field of Classification Search ..... 236/44 R, 236/44 C; 62/132; 700/276, 299
See application file for complete search history.

(56) References Cited

U.S. PATENT DOCUMENTS

| | | | | |
|---|---|---|---|---|
| 7,155,318 | B2 * | 12/2006 | Sharma et al. | 700/276 |
| 2005/0006084 | A1 * | 1/2005 | Yonekura et al. | 165/202 |
| 2005/0116023 | A1 * | 6/2005 | Amundson et al. | 235/376 |
| 2005/0131652 | A1 * | 6/2005 | Corwin et al. | 702/127 |

FOREIGN PATENT DOCUMENTS

| | | | | |
|---|---|---|---|---|
| JP | 02122139 | A | * | 5/1990 |
| JP | H02-122139 | A | | 5/1990 |
| JP | H03-225141 | A | | 10/1991 |
| JP | H05-106899 | A | | 4/1993 |
| JP | H07-071804 | A | | 3/1995 |
| JP | H09-303840 | A | | 11/1997 |
| JP | 2001-343144 | A | | 12/2001 |
| JP | 2001343144 | A | * | 12/2001 |
| JP | 2002-130765 | A | | 5/2002 |
| JP | 2003-185217 | A | | 7/2003 |
| JP | 2003185217 | A | * | 7/2003 |

* cited by examiner

*Primary Examiner* — Chen Wen Jiang
(74) *Attorney, Agent, or Firm* — Global IP Counselors

(57) ABSTRACT

An air conditioner has an automatic operation mode or other regular mode, and a rest operation mode. The air conditioner includes an indoor unit, an outdoor air-conditioning unit, an air supply/humidification unit, and a humidity control unit. The indoor unit, the outdoor air-conditioning unit, and the air supply/humidification unit humidify or dehumidify air and supply the air into a room. The humidity control unit controls the devices in the indoor unit, the outdoor air-conditioning unit, and the air supply/humidification unit during the regular mode so that the indoor humidity reaches a first target humidity. The humidity control unit also controls the devices in the indoor unit, the outdoor air-conditioning unit, and the air supply/humidification unit during the rest operation mode so that the indoor humidity reaches a second target humidity, which is lower than the first target humidity.

9 Claims, 7 Drawing Sheets

AIR CONDITIONER AND INDOOR HUMIDITY CONTROL METHOD

CROSS-REFERENCE TO RELATED APPLICATIONS

This U.S. National stage application claims priority under 35 U.S.C. §119(a) to Japanese Patent Application Nos. 2006-306028, filed in Japan on Nov. 10, 2006, the entire contents of which are hereby incorporated herein by reference.

TECHNICAL FIELD

The present invention relates to an air conditioner, and particularly to an air conditioner having a regular mode and a sleep mode. The present invention also relates to an indoor humidity control method for controlling indoor humidity.

BACKGROUND ART

Many modern air conditioners have various functions, such as a regular mode for making indoor temperature and humidity more comfortable, and a sleep mode for bedtime.

Sleep mode is a function for conditioning indoor air so that a user can sleep comfortably. One particular example of an air conditioner having the sleep mode is an air conditioner for adjusting indoor temperature in accordance with a user's biological rhythms during sleep, such as the air conditioner disclosed in Japanese Laid-open Patent Document No. 5-106899, for example.

SUMMARY OF THE INVENTION

<Technical Problem>

Examples of biological rhythms during sleep include those pertaining to temperature, such as the core body temperature decreasing when falling asleep and the body temperature returning to normal when awakening, as well as making it easier to fall asleep by sweating. Therefore, even if the temperature is adjusted in the same manner as with the air conditioner of patent document 1, the user has trouble falling asleep in cases of high indoor humidity because it is difficult for sweating to occur. The lower the indoor humidity when the user awakens, the thirstier the user is or the less moisture there is in the user's skin. During the winter season when the air is dry, these phenomena are particularly prominent.

In view of this, the present invention provides an air conditioner and a humidity control method whereby the indoor air can be adjusted so that a user indoors can sleep comfortably when a sleep mode has been set by the user.

<Solution to Problem>

An air conditioner according to a first aspect of the present invention is an air conditioner having a regular mode and a sleep mode. The air conditioner comprises a humidity adjustment unit and a humidity control unit. The humidity adjustment unit humidifies or dehumidifies air and supplies the air into a room. The humidity control unit controls the humidity adjustment unit during the regular mode so that the indoor humidity reaches a first target humidity. The humidity control unit also controls the humidity adjustment unit during the sleep mode so that the indoor humidity reaches a second target humidity, which is lower than the first target humidity.

For example, a user intending to sleep in a room provided with this air conditioner may set the air conditioner to the sleep mode. In this case, the air conditioner sets the indoor target humidity to be lower than during the regular mode. When the user is falling asleep, the indoor humidity is thereby set to a lower humidity than during the regular mode. Sweating is therefore promoted, and the user can sleep deeply.

An air conditioner according to a second aspect is the air conditioner according to the first aspect, wherein the second target humidity is within a range that is higher than the humidity at which the oral mucous membrane dries up and lower than the humidity at which mold forms.

The room interior is thereby maintained at a comfortable humidity level for a user falling asleep in cases in which the air conditioner has been set to the sleep mode.

An air conditioner according to a third aspect is the air conditioner according to the first or second aspect, wherein the second target humidity is an absolute humidity.

Conventional air conditioners have controlled based on relative humidity. However, the air conditioner according to the third aspect uses absolute humidity as the target humidity and controls in accordance with the absolute humidity, or the relative humidity in a manner equivalent to the absolute humidity, so that the indoor humidity reaches the target humidity. The room interior thereby reaches a comfortable humidity level for a user falling asleep.

An air conditioner according to a fourth aspect is the air conditioner according to any of the first through third aspects, further comprising a temperature adjustment unit and a temperature control unit. The temperature adjustment unit cools or heats air to adjust the indoor temperature. The temperature control unit controls the temperature adjustment unit during the sleep mode so that the indoor temperature reaches a second target temperature, which is below a first target temperature set during the regular mode.

The air conditioner further controls the temperature so that the indoor temperature decreases in accordance with the decrease in a user's core body temperature when the user is sleeping, for example. Thus, the user can sleep deeply due to the temperature being controlled in addition to the humidity when the user is falling asleep.

An air conditioner according to a fifth aspect is an air conditioner having a regular mode and a sleep mode. The air conditioner comprises a humidity adjustment unit, a command receive unit, and a humidity control unit. The humidity adjustment unit humidifies or dehumidifies air and supplies the air into a room. The command receive unit receives operation initiation commands for the regular mode or the sleep mode. The humidity control unit controls the humidity adjustment unit so that the indoor humidity reaches a third target humidity when the command receive unit has received a command to initiate the regular mode operation. The humidity control unit also controls the humidity adjustment unit so that the indoor humidity reaches a fourth target humidity, which is higher than the third target humidity, when a predetermined time period has passed after the command receive unit received a command to initiate the sleep mode operation.

For example, a user intending to sleep in a room provided with this air conditioner may set the air conditioner to the sleep mode. In this case, the air conditioner adjusts the indoor target humidity to be higher than during the regular mode when a predetermined time period has passed after the sleep mode operation was initiated. The indoor humidity is thereby set to a higher humidity than during the regular mode when the user wakes up. Consequently, sweating in the user is suppressed, as is skin or throat dryness.

An air conditioner according to a sixth aspect is the air conditioner according to the fifth aspect, wherein the fourth target humidity is within a range that is higher than the humidity at which the oral mucous membrane dries up and lower than the humidity at which mold forms.

The room interior is thereby maintained at a humidity at which an appropriate amount of moisture is contained in the user's skin or throat when the user wakes up.

An air conditioner according to a seventh aspect is the air conditioner according to the fifth or sixth aspect, wherein the fourth target humidity is an absolute humidity.

Conventional air conditioners have controlled based on relative humidity. However, the air conditioner according to the seventh aspect uses absolute humidity as the target humidity and controls in accordance with the absolute humidity, or the relative humidity in a manner equivalent to the absolute humidity, so that the indoor humidity reaches the target humidity. The user can thereby be woken up with a more appropriate amount of moisture in the skin and throat.

An air conditioner according to an eighth aspect is the air conditioner according to any of the fifth through seventh aspects, further comprising a temperature adjustment unit and a temperature control unit. The temperature adjustment unit heats or cools air to adjust the indoor temperature. The temperature control unit controls the temperature adjustment unit so that the indoor temperature reaches a fourth target temperature, which is below a third target temperature set during the regular mode, when the command receive unit has received a command to initiate the sleep mode operation. The temperature control unit also controls the temperature adjustment unit so that the indoor temperature reaches the third target temperature when at least the predetermined time period has passed after the command receive unit received the command to initiate the sleep mode operation.

The air conditioner further controls the temperature so that the lowered indoor temperature is raised in accordance with the increase in the user's body temperature when the user wakes up, for example. Thus, the user can be woken up more comfortably by controlling the temperature in addition to humidity during waking.

A humidity control method according to a ninth aspect is a method for controlling indoor humidity so that the indoor humidity during a regular mode reaches a fifth target humidity. The humidity control method comprises steps 1 through 3. Step 1 is a step for receiving a command to initiate a sleep mode operation. Step 2 is a step for dehumidifying or humidifying air and supplying the air into a room so that the indoor humidity reaches a sixth target humidity, which is lower than the fifth target humidity. Step 3 is a step for humidifying air and supplying the air into the room so that the indoor humidity reaches a seventh target humidity, which is higher than the fifth target humidity, when a predetermined time period has passed after the operation initiation command was received.

Sweating is thereby promoted when the user is falling asleep because the indoor humidity is lower than the humidity during the regular mode. Consequently, the user can sleep deeply. The indoor humidity is thereby higher than the humidity during the regular mode when the user wakes up, and sweating in the user is therefore suppressed, as is skin and throat dryness.

ADVANTAGEOUS EFFECTS OF INVENTION

With the air conditioner according to the first aspect, sweating is promoted when the user is falling asleep, and the user can sleep deeply.

With the air conditioner according to the second aspect, the room interior is maintained at a humidity at which a user can fall asleep comfortably.

With the air conditioner according to the third aspect, the room interior reaches a more comfortable humidity when the user is falling asleep.

With the air conditioner according to the fourth aspect, the user can sleep more deeply because the temperature is controlled in addition to the humidity when the user is falling asleep.

With the air conditioner according to the fifth aspect, sweating in the user is suppressed when the user wakes up, as is skin and throat dryness.

With the air conditioner according to the sixth aspect, the room interior is maintained at a humidity at which an appropriate amount of moisture is contained in the user's skin or throat when the user wakes up.

With the air conditioner according to the seventh aspect, the user can wake up with a more appropriate amount of moisture in the skin or throat.

With the air conditioner according to the eighth aspect, the user can be woken up more comfortably by controlling the temperature in addition to humidity during waking.

With the humidity control method according to the ninth aspect, sweating is promoted when the user is falling asleep, and the user can sleep deeply. Sweating in the user is also suppressed when the user wakes up, as is skin or throat dryness.

DETAILED DESCRIPTION OF THE INVENTION (1) Configuration of Air Conditioner

Figure 1:
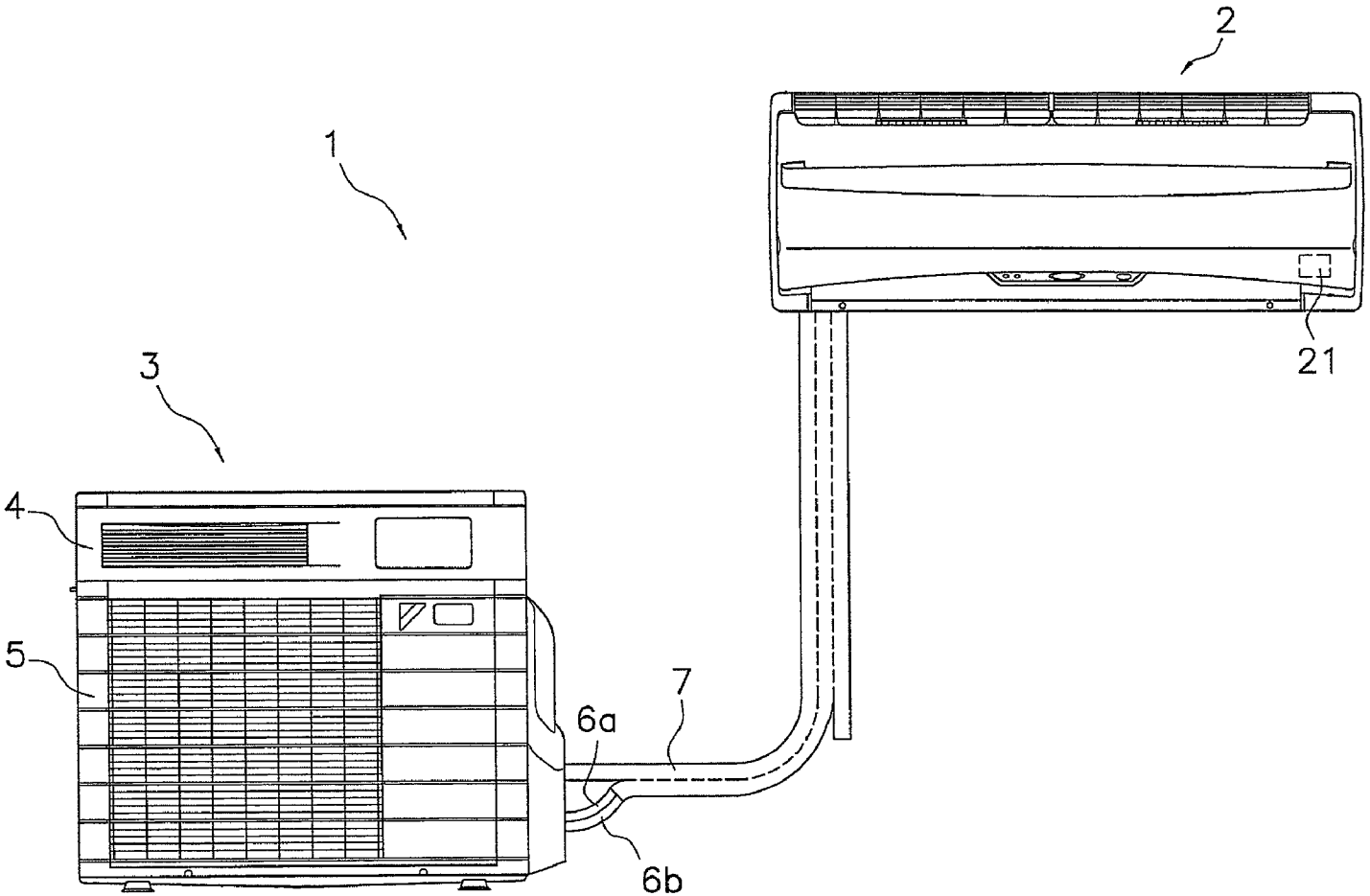
FIG. 1 is an external view of the air conditioner according to the present embodiment.

FIG. 1 is an external view of an air conditioner according to an embodiment of the present invention. This air conditioner 1 is divided into an indoor unit 2 mounted on an indoor wall surface or the like, and an outdoor unit 3 installed outdoors. In addition to indoor cooling and heating operations, a dehumidifying operation, and a humidifying operation, the air conditioner 1 has an automatic operating mode (equivalent to a regular mode), a rest operating mode (equivalent to a sleep mode), and other functions.

Figure 3:
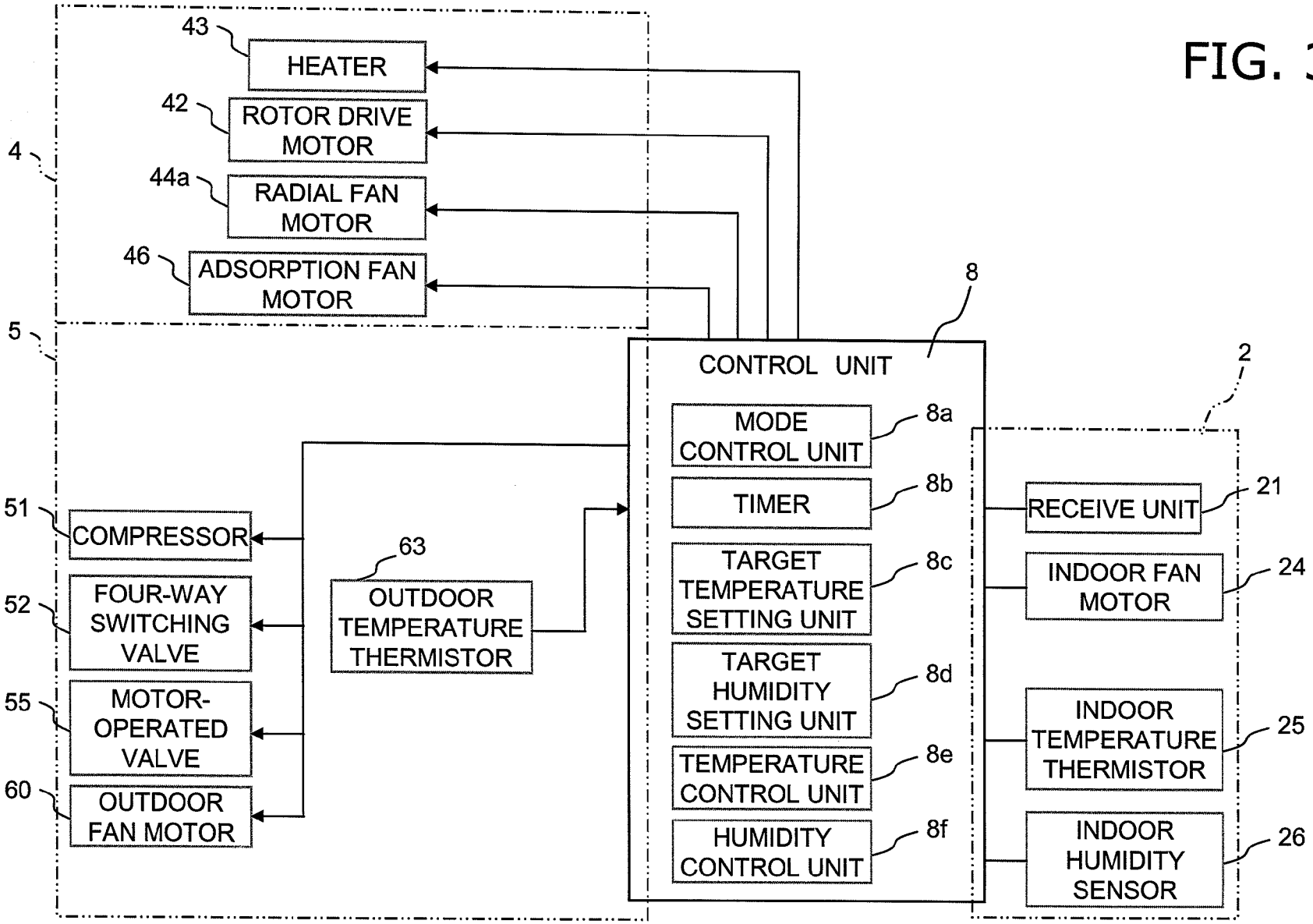
FIG. 3 is a diagram schematically depicting the connections between the control unit of the air conditioner according to the present embodiment and the peripheral devices of the control unit.

The indoor unit 2 is provided with a receive unit 21, an indoor temperature thermistor 25, an indoor humidity sensor 26, and other components, as shown in FIGS. 1 and 3. The receive unit 21 is provided so as to be capable of receiving commands sent from a remote controller, for example, to initiate the automatic operating mode, the rest operating mode, and other various functions. The indoor temperature thermistor 25 and the indoor humidity sensor 26 sense the indoor temperature and humidity, respectively. Furthermore, the interior of the indoor unit 2 also houses an indoor heat exchanger 22, an indoor fan motor 24, and other components, but these are described hereinafter.

The outdoor unit 3 comprises an outdoor air-conditioning unit 5, which an outdoor heat exchanger 54 (described hereinafter), an outdoor temperature thermistor 63 for sensing the outdoor temperature, and other components are provided therein; and an air supply/humidification unit 4 for supplying air drawn in from the outside into a room, either directly or after humidification.

The heat exchangers and refrigerant supply tubes 6*a*, 6*b* for connecting the heat exchangers constitute a refrigerant circuit. Provided between the indoor unit 2 and the outdoor unit 3 is an air supply tube 7 used when air sent from the air supply/humidification unit 4 is supplied toward the indoor unit 2.

(1-1) Configuration of Refrigerant Circuit

Figure 2:
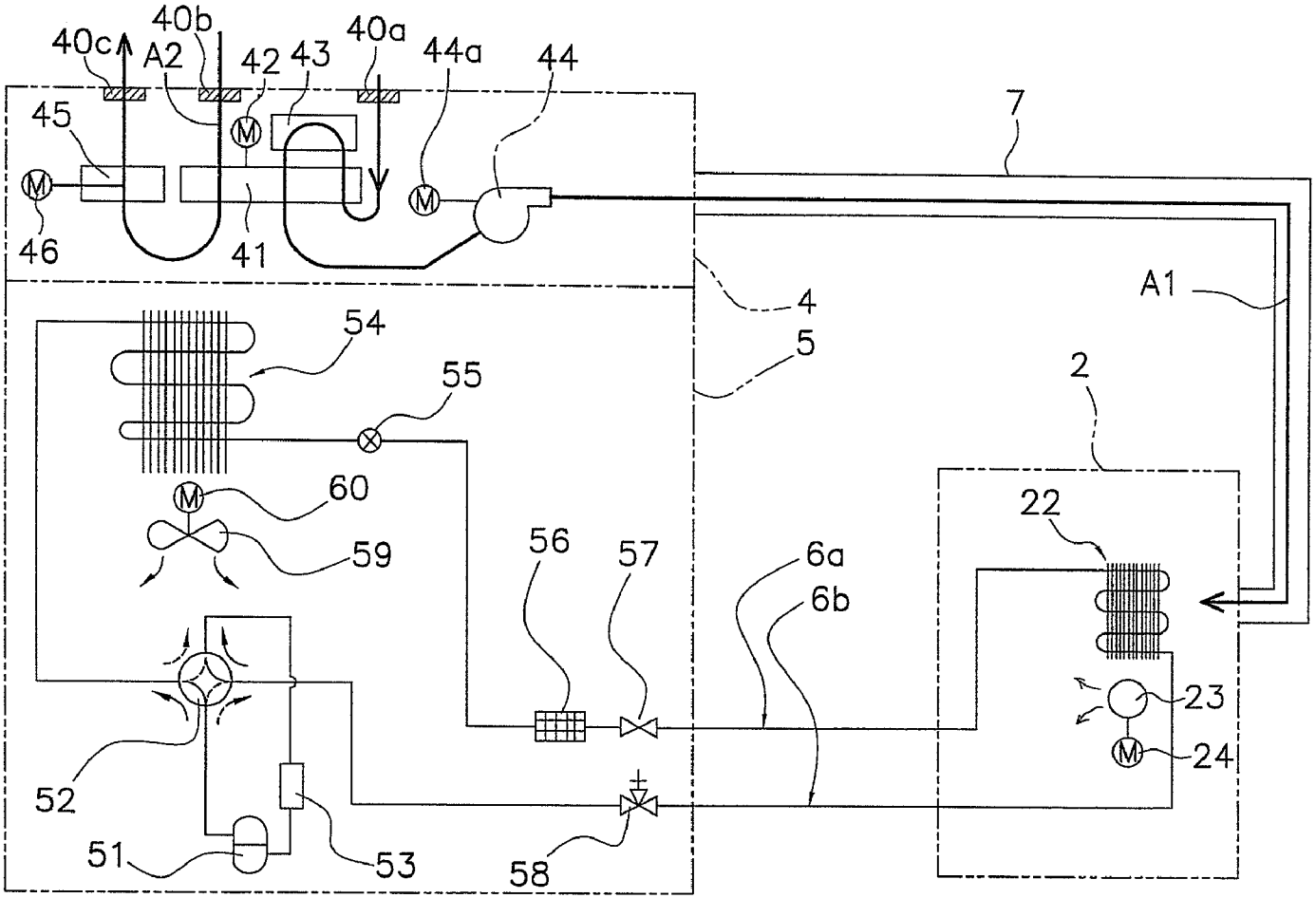
FIG. 2 is a diagram showing the configuration of the refrigerant circuit and air supply/humidification unit according to the present embodiment, and the air flow therein.

Next, the refrigerant circuit used by the air conditioner 1 of the present embodiment will be described together with the internal configurations of the indoor unit 2 and the outdoor unit 3. FIG. 2 is a schematic diagram of the refrigerant circuit used by the air conditioner 1.

<Indoor Unit >

The indoor heat exchanger 22, a cross-flow fan 23, and the indoor fan motor 24 are provided in the indoor unit 2. The indoor heat exchanger 22 is composed of a heat exchanger tube which folds back multiple times at both longitudinal ends, and a plurality of fins through which the heat exchanger tube passes; and the indoor heat exchanger 22 exchanges heat with the air with which it comes in contact. For example, the indoor heat exchanger 22 functions as an evaporator during the cooling operation or during a drying operation. Consequently, when indoor air comes in contact with the indoor heat exchanger 22 functioning as an evaporator, the moisture in the air condenses into water droplets and drips down into a drain pan (not shown) provided underneath the indoor heat exchanger 22. The temperature and humidity in the indoor air thereby decrease. During the heating operation, indoor air coming in contact with the indoor heat exchanger 22 is warmed because the indoor heat exchanger 22 functions as a condenser.

The cross-flow fan 23 is configured into a cylindrical shape with numerous blades provided around the peripheral surface, and the cross-flow fan 23 generates an air flow in a direction intersecting with the rotational axis. The cross-flow fan 23 causes indoor air to be drawn into the indoor unit 2, and also blows out air into the room after the air has exchanged heat with the indoor heat exchanger 22. The purpose of the indoor fan motor 24 is to rotatably drive the cross-flow fan 23.

<Outdoor Air-Conditioning Unit>

Provided in the interior of the outdoor air-conditioning unit 5 are a compressor 51, a four-way switching valve 52 connected at the discharge side of the compressor 51, an accumulator 53 connected at the intake side of the compressor 51, the outdoor heat exchanger 54 connected to the four-way switching valve 52, and an motor-operated valve 55 connected to the outdoor heat exchanger 54. The motor-operated valve 55 is connected to the refrigerant supply tube 6*a* via a filter 56 and a liquid shutoff valve 57, and is also connected to one end of the indoor heat exchanger 22 via the refrigerant supply tube 6*a*. The four-way switching valve 52 is connected to the refrigerant supply tube 6*b* via a gas shutoff valve 58, and is also connected to the other end of the indoor heat exchanger 22 via the refrigerant supply tube 6*b*. The four-way switching valve 52 switches the flow of the refrigerant between cooling and heating operation.

A propeller fan 59 is provided inside the outdoor air-conditioning unit 5. The purpose of the propeller fan 59 is to discharge air to the exterior after the air has undergone heat exchange in the outdoor heat exchanger 54, and the propeller fan 59 is rotatably driven by an outdoor fan motor 60.

(1-2) Configuration of Air Supply/Humidification Unit

Next, the configuration of the air supply/humidification unit 4 will be described using FIG. 2. The air supply/humidification unit 4 includes a moisture-adsorbing/humidifying rotor 41, a heater 43, a radial fan assembly 44, and an adsorption fan 45.

The moisture-adsorbing/humidifying rotor 41 is a ceramic rotor with a honeycomb structure having a substantially circular shape, wherein air can easily pass through. The moisture-adsorbing/humidifying rotor 41 is rotatably driven by a rotor drive motor 42. Zeolite, silica gel, alumina, or another adsorbent is supported on the moisture-adsorbing/humidifying rotor 41. The zeolite adsorbent is capable of adsorbing moisture in the air with which it comes in contact, and the adsorbent has the property of being caused to desorb moisture by heating.

During the humidifying operation, the heater 43 heats air taken in from outdoors and sent to the moisture-adsorbing/humidifying rotor 41.

The radial fan 44 is disposed to the side of the moisture-adsorbing/humidifying rotor 41 and is driven by a radial fan motor 44*a*. The radial fan 44 creates an air flow (A1 in FIG. 2) that moves from an air supply port 40*a* for guiding in air from outdoors, through the moisture-adsorbing/humidifying rotor 41, and into the room. The radial fan 44 has the role of sending air from outdoors to the indoor unit 2 via the air supply tube 7.

The adsorption fan 45 is rotatably driven by an adsorption fan motor 46. The adsorption fan 45 creates an air flow (A2 in FIG. 2) so that air taken in from an adsorption air intake port 40*b* is discharged outdoors via an adsorption air suction port 40*c*. The adsorption air intake port 40*b* is an opening for the passage of air taken in from outside the air supply/humidification unit 4 in order to allow moisture to be adsorbed on the moisture-adsorbing/humidifying rotor 41, and the adsorption air suction port 40*c* is an opening for discharging air outdoors after the moisture in the air has been adsorbed by the moisture-adsorbing/humidifying rotor 41.

During humidification with this type of air supply/humidification unit 4, the heater 43 turns on, the air taken in from the air supply port 40*a* is heated by the heater, and the air containing the moisture desorbed from the moisture-adsorbing/humidifying rotor 41 is sent to the air supply tube 7. When air is supplied in the absence of humidification, the heater 43 turns off, and the air taken in from the air supply port 40*a* is sent directly to the air supply tube 7.

(1-3) Configuration of Control Unit

Next, a control unit 8 for controlling the air conditioner 1 will be described using FIG. 3. The control unit 8 is a microcomputer composed of a CPU and memory, and is separated into electrical equipment boxes or the like disposed in the indoor unit 2 and in the outdoor unit 3. The control unit 8 is connected to the devices of the indoor unit 2 and outdoor unit 3, and the control unit 8 controls the devices to which it is connected. Particularly, the control unit 8 according to the present embodiment controls the indoor humidity and temperature in accordance with human biological rhythms when the receive unit 21 of the indoor unit 2 has received a command to initiate the rest operation mode. In order to perform such an action, the control unit 8 functions as a mode control unit 8*a*, a timer 8*b*, a target temperature setting unit 8*c*, a target humidity setting unit 8*d*, a temperature control unit 8*e*, and a humidity control unit 8*f*. The functions are described hereinbelow.

<Mode Control Unit>

When the receive unit 21 of the indoor unit 2 receives various operation commands from a remote controller or the like, the mode control unit 8*a* controls the operation mode of the air conditioner 1 in accordance with the operation command. Specifically, in cases in which the receive unit 21 has received a command to initiate the automatic operation mode, a command to initiate the rest operation mode, or another command, the mode control unit 8*a* outputs a mode setting signal indicating the command to the timer 8*b*, the target temperature setting unit 8*c*, and the target humidity setting unit 8*d*. In the present embodiment, the mode setting signal indicating the command to initiate the rest operation mode is assumed to include a scheduled waking time set by the user via the remote controller.

<Timer>

The timer 8*b* initiates the output of time information upon acquiring a mode setting signal from the mode control unit 8*a*. The time information outputted from the timer 8*b* is received by the target temperature setting unit 8*c* and the target humidity setting unit 8*d*.

<Target Temperature Setting Unit>

The target temperature setting unit 8*c* sets an indoor target temperature on the basis of the mode setting signal acquired from the mode control unit 8*a*. Specifically, the target temperature setting unit 8*c* sets the indoor target temperature to a first target temperature TM in cases in which the target temperature setting unit 8*c* has acquired a mode setting signal indicating a command to initiate the automatic operation mode. The target temperature setting unit 8*c* sets the target temperature in accordance with human biological rhythms in cases in which the target temperature setting unit 8*c* has acquired a mode setting signal indicating a command to initiate the rest operation mode.

Figure 4:
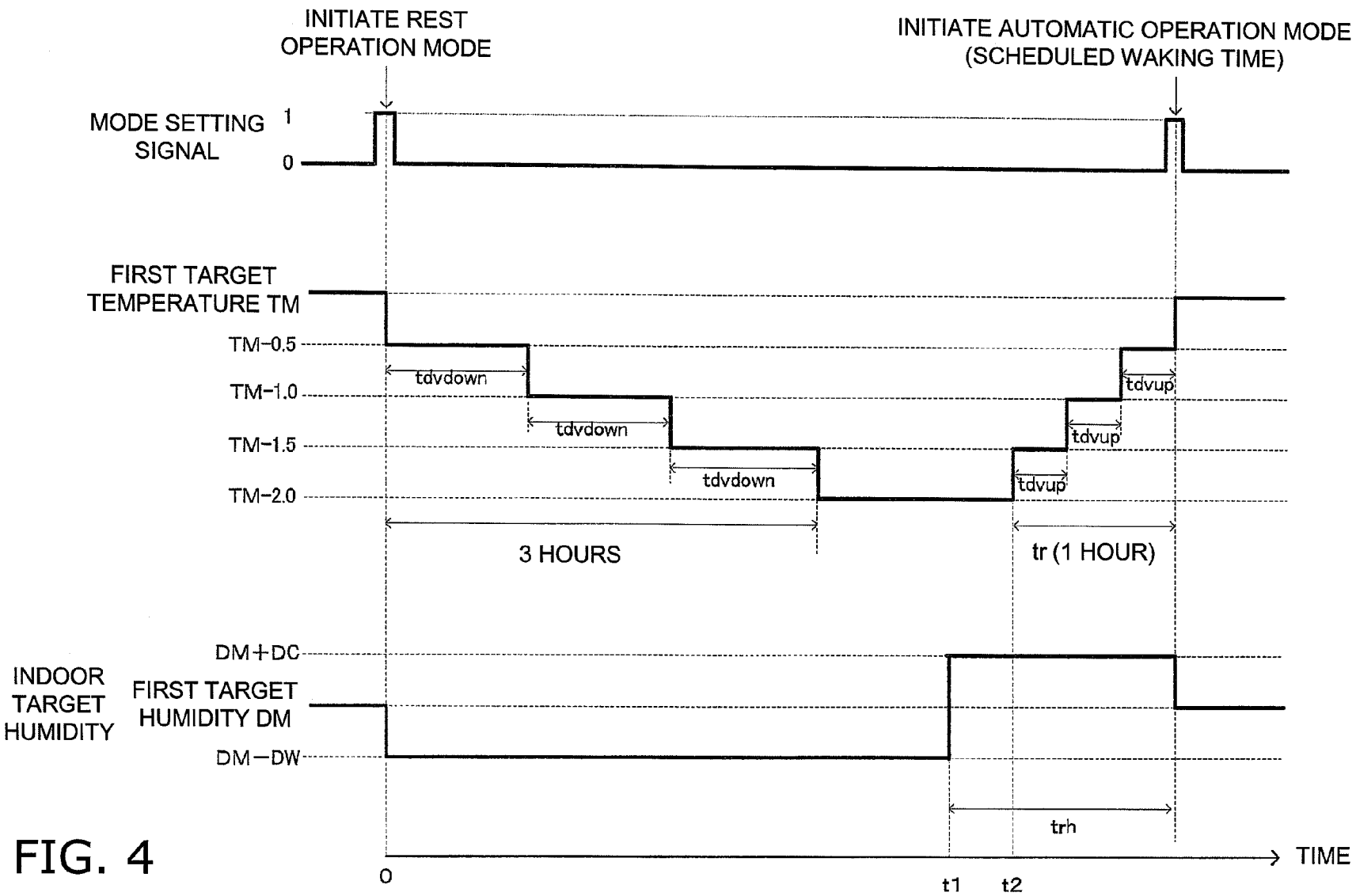
FIG. 4 is a diagram depicting the indoor target temperature and target humidity over time, as controlled by the air conditioner according to the present embodiment.

FIG. 4 is used to describe the manner in which the target temperature setting unit 8*c* sets the target temperature in cases in which the target temperature setting unit 8*c* has acquired a mode setting signal indicating a command to initiate the rest operation mode. Upon acquiring a mode setting signal indicating a command to initiate the rest operation mode, the target temperature setting unit 8*c* first sets the indoor target temperature to a temperature 0.5 degrees less than the first target temperature TM, and continues to lower the target temperature by 0.5-degree at intervals of a time period "tdvdown," as shown in FIG. 4. The target temperature setting unit 8*c* repeats this action until the indoor target temperature reaches a temperature approximately 2 degrees less than the first target temperature TM. For this action, the time period "tdvdown" is adjusted so that the target temperature promptly reaches a temperature approximately 2 degrees less than the first target temperature TM at, e.g., 3 hours after the rest operation mode was initiated.

When a predetermined time period t2 elapses after the acquisition of the mode setting signal indicating a command to initiate the rest operation mode, the target temperature setting unit 8*c* first raises the indoor target temperature by 0.5 degrees. When a time period "tdvup" elapses after the indoor target temperature has been raised by 0.5 degrees, the target temperature setting unit 8*c* raises the target temperature another 0.5 degrees. The target temperature setting unit 8*c* repeats this action until the target temperature reaches the original first target temperature TM. For this action, the time period "tdvup" is adjusted so that the target temperature promptly reaches the first target temperature TM at, e.g., the scheduled waking time.

To start raising the target temperature after the passage of the predetermined time period t2, the target temperature setting unit 8*c* calculates the time remaining in the rest operation mode from the user's scheduled waking time and the current time. The target temperature setting unit 8*c* may perform the aforementioned action in cases in which the remaining time is less than a predetermined time period "tr." The predetermined time period "tr" can be set to 1 hour, for example. The predetermined time period t2 is assumed to be a pre-established time period.

It is assumed that the time information outputted from the timer 8*b* is used to determine whether or not the time period has reached the predetermined time period t2.

<Target Humidity Setting Unit>

The target humidity setting unit 8*d* sets the indoor target humidity at an absolute humidity level on the basis of the mode setting signal acquired from the mode control unit 8*a*. Specifically, the target humidity setting unit 8*d* sets the indoor target humidity to a first target humidity DM in cases in which a mode setting signal indicating a command to initiate the automatic operation mode has been acquired. The target humidity setting unit 8*d* also sets the target humidity in accordance with sleeping, waking, and other user actions, in cases in which a mode setting signal indicating a command to initiate the rest operation mode has been acquired.

FIG. 4 is used to describe the manner in which the target humidity setting unit 8*d* sets the target humidity in cases in which the target humidity setting unit 8*d* has acquired a mode setting signal indicating a command to initiate the rest operation mode, similar to the target temperature setting unit 8*c*. Upon acquiring a mode setting signal indicating a command to initiate the rest operation mode, the target humidity setting unit 8*d* sets the indoor target humidity to a humidity (DM−DW) less than the first target humidity DM by a predetermined humidity DW, as shown in FIG. 4. When a predetermined time period t1 elapses after the acquisition of the mode setting signal indicating a command to initiate the rest operation mode, the target humidity setting unit 8*d* then sets the indoor target humidity to a humidity (DM+DC) higher than the first target humidity DM by a predetermined humidity DC. When the rest operation mode ends and automatic operation or another regular mode is restored, the target humidity setting unit 8*d* sets the target humidity to the first target humidity DM.

Figure 5:
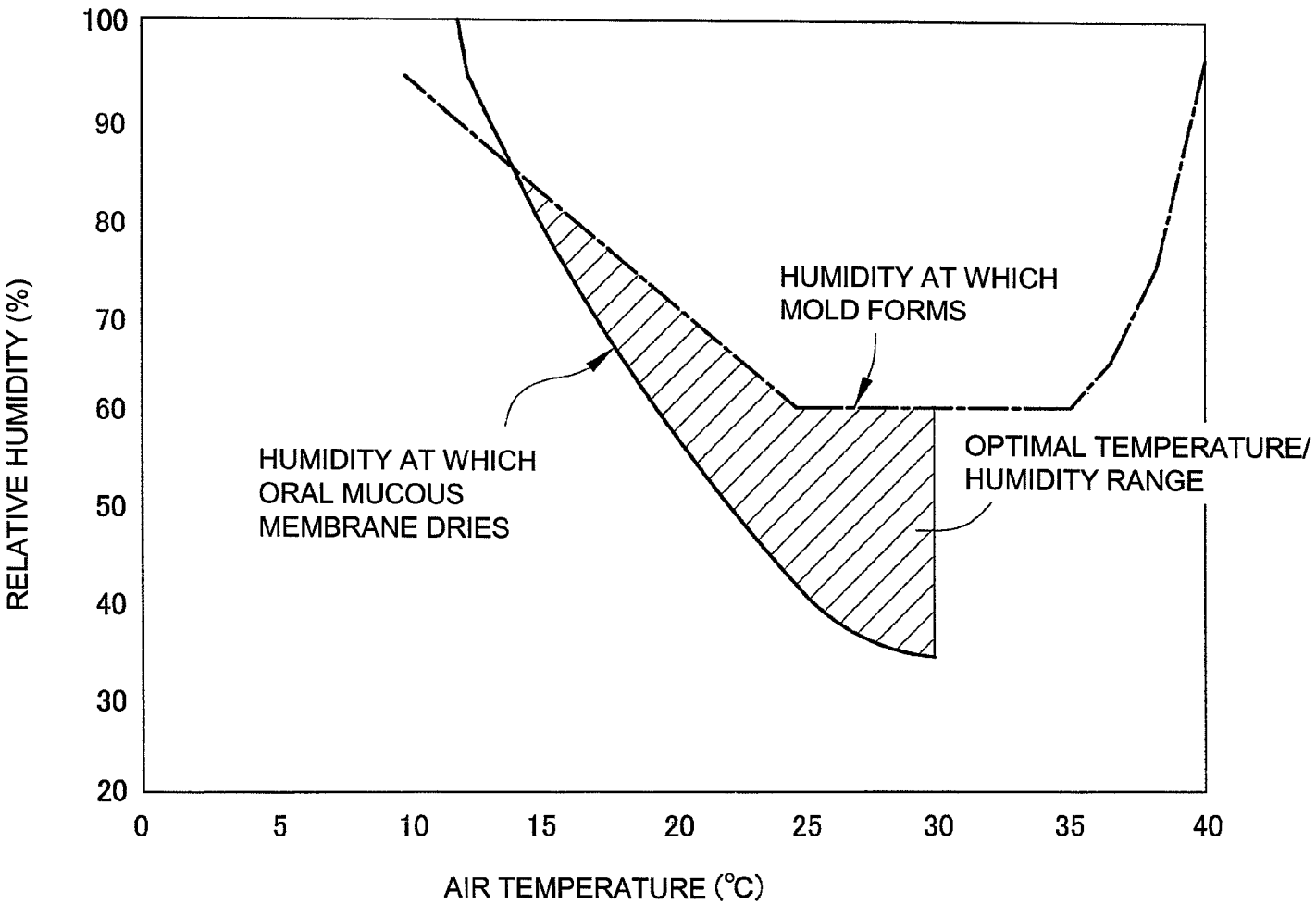
FIG. 5 is a diagram showing the range in which the target temperature and target humidity are set.

The predetermined humidity levels DW, DC are empirically established values. In the present embodiment, relative humidity levels obtained by conversion from the individual target humidity levels (absolute humidity levels) set at different times as described above are included in the shaded area of the graph shown in FIG. 5. The shaded area in the graph in FIG. 5 represents a range that is higher than the humidity at which the oral mucous membrane dries up and lower than the humidity at which mold forms. Thus, these individual target humidity levels (absolute humidity levels) fall within the range of absolute humidity levels converted from the range in FIG. 5 (relative humidity levels), whereby the indoor humidity is maintained in the range resulting from the conversion. Consequently, the user of a room, particularly when waking, can wake up comfortably without feeling thirsty and without feeling a lack of skin moisture or other uncomfortable sensations.

The predetermined time period t1 is a pre-established time period, as is the predetermined time period t2.

The time information outputted from the timer 8*b* is also used to determine whether or not the time period has reached the predetermined time period t1, similar to the target temperature setting unit 8*c*.

<Temperature Control Unit>

The temperature control unit 8*e* controls the devices of the indoor unit 2 and the outdoor air-conditioning unit 5 so that the indoor temperature reaches the target temperature set by the target temperature setting unit 8*c*.

Specifically, during the automatic operation mode, the temperature control unit 8*e* controls the devices in the refrigerant circuit on the basis of the indoor temperature sensed by the indoor temperature thermistor 25 so that heated or cooled air is sent into the room to bring the indoor temperature to the first target temperature TM.

In the rest operation mode, the temperature control unit 8*e* controls the devices in the refrigerant circuit on the basis of the indoor temperature sensed by the indoor temperature thermistor 25 so that the indoor temperature reaches the target temperature individually set at different times by the target temperature setting unit 8*c*.

<Humidity Control Unit>

The humidity control unit 8*f* controls the devices of the indoor unit 2, the outdoor air-conditioning unit 5 (specifically, the refrigerant circuit), and the air supply/humidification unit 4 so that the indoor humidity reaches the target humidity set by the target humidity setting unit 8*d*.

For example, during a normal operating mode, the humidity control unit 8*f* controls the devices in the refrigerant circuit and the air supply/humidification unit 4 on the basis of the indoor humidity sensed by the indoor humidity sensor 26 so that humidified or dehumidified air is sent into the room to bring the indoor humidity to the first target humidity DM.

During the rest operation mode, the temperature control unit 8*e* controls the devices in the refrigerant circuit and the air supply/humidification unit 4 on the basis of the indoor humidity sensed by the indoor humidity sensor 26 so that the indoor humidity reaches the individual target humidity set at different times by the target humidity setting unit 8*d*.

The humidity control unit 8*f* according to the present embodiment performs absolute humidity control because the set target humidity is an absolute humidity. On the other hand, the indoor humidity sensed by the indoor humidity sensor 26 is a relative humidity. In view of this, the humidity control unit 8*f* uses the indoor temperature sensed by the indoor temperature thermistor 25 to convert the indoor humidity sensed by the indoor humidity sensor 26 into an absolute humidity, and controls so that the converted absolute humidity reaches the individual target humidity. Thus, the humidity control unit 8*f* performs absolute humidity control, thereby creating a more comfortable indoor humidity for the user.

(2) Operation

Figure 6:
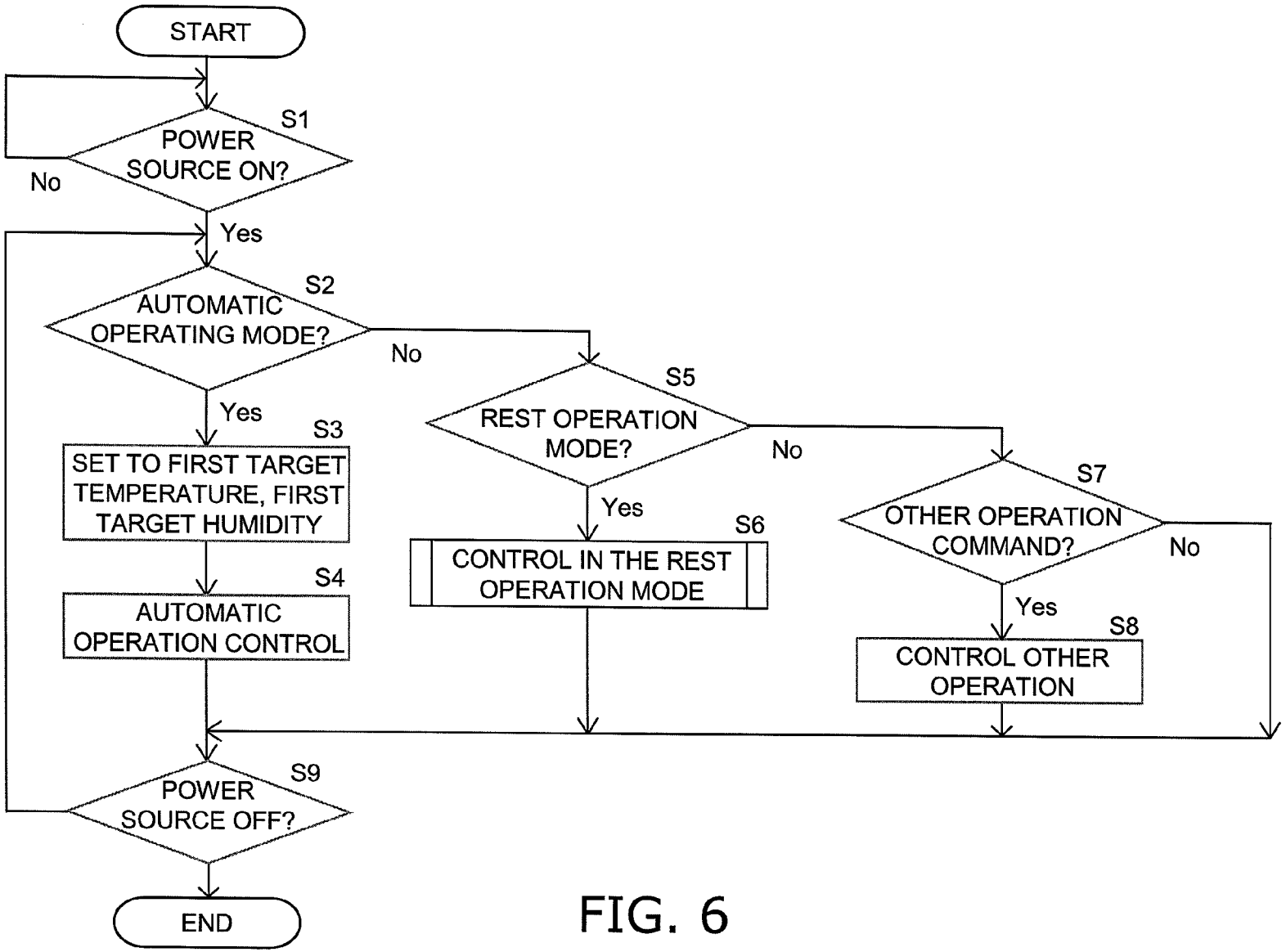
FIG. 6 is a flowchart showing the overall operational flow of the air conditioner according to the present embodiment.

Next, the operation of the air conditioner 1 will be described. FIG. 6 is a flowchart showing the overall operational flow of the air conditioner 1.

Step S1: Assume that the receive unit 21 in the indoor unit 2 of the air conditioner 1 receives a command to turn on the power source of the air conditioner 1 from a remote controller or the like (S1), and then that various operation initiation commands are received.

Steps S2 to S4: In cases in which the operation initiation command received by the receive unit 21 of the indoor unit 2 is for the automatic operation mode (S2), the mode control unit 8*a* outputs a mode setting signal indicating a command to initiate the automatic operation mode to the timer 8*b*, the target temperature setting unit 8*c*, and the target humidity setting unit 8*d*. The target temperature setting unit 8*c* and the target humidity setting unit 8*d* set the indoor target temperature and target humidity to the first target temperature TM and the first target humidity DM, respectively (S3). The temperature control unit 8*e* and the humidity control unit 8*f* automatically control the indoor temperature and humidity (S4). Specifically, the temperature control unit 8*e* and the humidity control unit 8*f* control the respective devices in the refrigerant circuit and the air supply/humidification unit 4 so that the indoor temperature and humidity reach the first target temperature TM and the first target humidity DM.

Steps S5 and 6: In cases in which the operation initiation command received by the receive unit 21 of the indoor unit 2 is for the rest operation mode (S5), the mode control unit 8*a* outputs a mode setting signal indicating a command to initiate the rest operation mode to the timer 8*b*, the target temperature setting unit 8*c*, and the target humidity setting unit 8*d*. The control unit 8 controls in the rest operation mode (S6). Control in the rest operation mode is described hereinafter.

Steps S7 and 8: The operation initiation command received by the receive unit 21 of the indoor unit 2 may be an operation initiation command for, e.g., heating, cooling, or another operation (S7). In such cases, the mode control unit 8*a* notifies the timer 8*b*, the target temperature setting unit 8*c*, and the target humidity setting unit 8*d* of this command. The control unit 8 controls the operation as instructed (S8).

Step S9: In cases in which the receive unit 21 of the indoor unit 2 has received a command to turn off the power source of the air conditioner 1 from a remote controller or the like (S9), the air conditioner 1 stops operating. The air conditioner 1 will repeat the actions from step S2 onward until the receive unit 21 of the indoor unit 2 receives a command to turn the power source off.

(2-1) Control Operation in Rest Operation Mode

Figure 7:
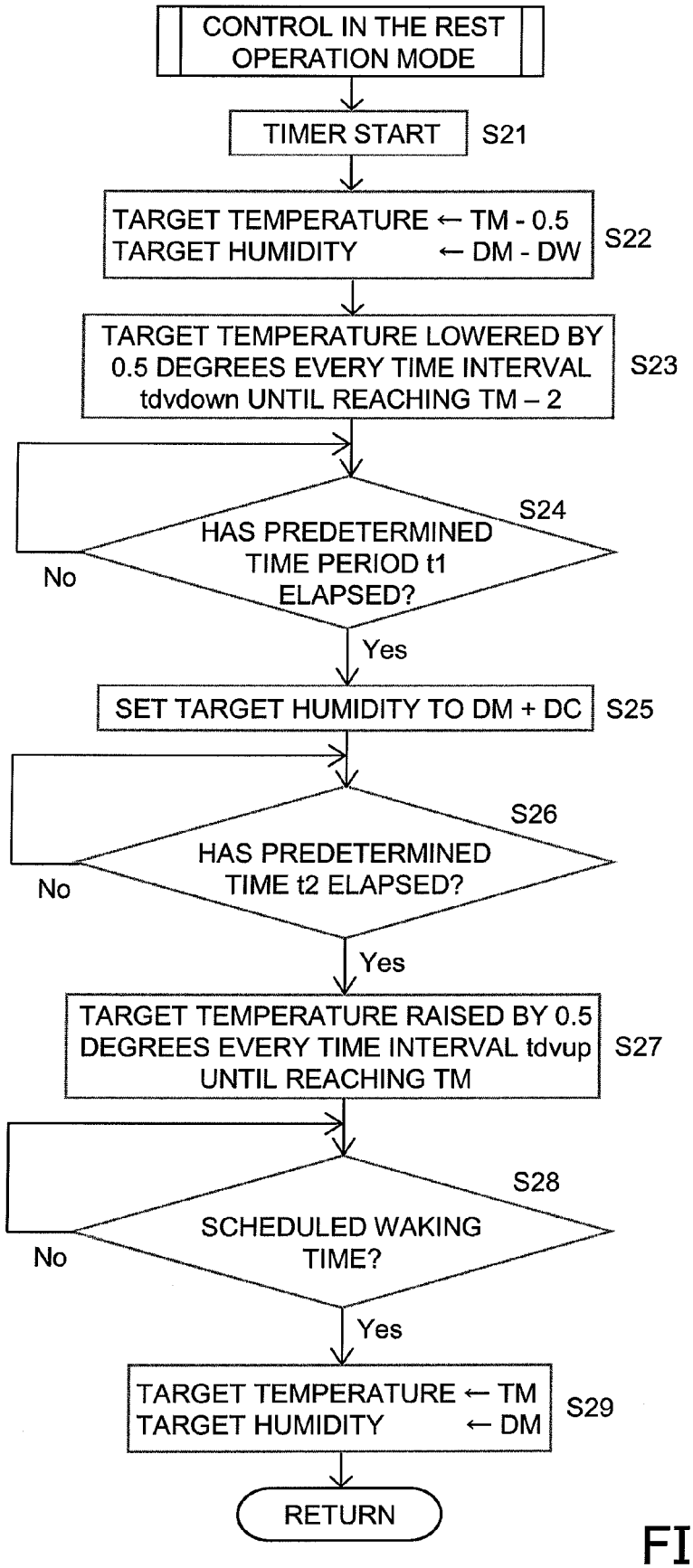
FIG. 7 is the sub-routine of control in the rest operation mode of the air conditioner according to the present embodiment.

FIG. 7 is a flowchart describing control in the rest operation mode.

Step S21: The timer 8*b* of the control unit 8 begins to output time information upon acquiring a mode setting signal indicating a command to initiate the rest operation mode from the mode control unit 8*a*.

Step S22: The target temperature setting unit 8*c* sets the indoor target temperature (TM−0.5) to 0.5 degrees less than the first target temperature TM, and the target humidity setting unit 8*d* sets the indoor target humidity (DM—DW) to be less than the first target humidity DM by the predetermined humidity DW. The temperature control unit 8*e* controls the devices in the refrigerant circuit so that the indoor temperature reaches the target temperature (TM−0.5). The humidity control unit 8*f* converts the indoor humidity sensed by the indoor humidity sensor 26 into an absolute humidity, and controls the devices in the refrigerant circuit and the air supply/humidification unit 4 so that the converted absolute humidity reaches the target humidity (DM−DW).

Step S23: The target temperature setting unit 8*c* lowers the target temperature by 0.5 degrees with every time interval "tdvdown" until the indoor target temperature reaches "TM−2" degrees. The temperature control unit 8*e* controls the devices in the refrigerant circuit so that the indoor temperature reaches the individual target temperature set at different times by the target temperature setting unit 8*c*.

Steps S24 and 25: At a certain time period, i.e., when the time information from the timer 8*b* reaches the predetermined time period t1 after the acquisition of a mode setting signal indicating a command to initiate the rest operation mode (S24), the target humidity setting unit 8*d* sets the target humidity to "DM+DC," which is higher than the first target humidity DM by a predetermined humidity DC (S25). The humidity control unit 8*f* converts the indoor humidity sensed by the indoor humidity sensor 26 into an absolute humidity and controls the devices in the refrigerant circuit and the air supply/humidification unit 4 so that the converted absolute humidity reaches the target humidity DM+DC.

Steps S26 and 27: At a certain time period, i.e., when the time information from the timer 8*b* reaches the predetermined time period t2 after the acquisition of a mode setting signal indicating a command to initiate the rest operation mode (S26), the target temperature setting unit 8*c* raises the target temperature by 0.5 degrees with each time interval "tdvup" until the target temperature reaches the first target humidity DM (S27). The temperature control unit 8*e* controls the devices in the refrigerant circuit so that the indoor temperature reaches the individual target temperature set at different times by the target temperature setting unit 8*c*.

Steps S28 and 29: When the time information from the timer 8*b* reaches the scheduled waking time (S28), the target temperature setting unit 8*c* sets the indoor target temperature to the first target temperature TM, and the target humidity setting unit 8*d* sets the indoor target humidity to the first target humidity DM (S29). The temperature control unit 8*e* controls so that the indoor temperature reaches the first target temperature TM, and the humidity control unit 8*f* controls so that the indoor humidity reaches the first target humidity DM. The mode control unit 8*a* presents the timer 8*b*, the target temperature setting unit 8*c*, and the target humidity setting unit 8*d* with an outputted mode setting signal for switching the operation mode to the automatic operation mode. The functional units in the control unit 8 are thereby caused to operate in the automatic mode.

(3) Effects

In the air conditioner 1 of the present embodiment, setting the rest operation mode causes the indoor target humidity to be set to a humidity "DM−DW", which is less by the predetermined humidity DW than the first target humidity DM maintained during the automatic operation mode or another regular mode, and the indoor humidity is controlled. Sweating is promoted and the user can sleep deeply because the indoor humidity is thereby brought to a lower level than in a regular mode when the user is falling asleep.

In the air conditioner 1, when the predetermined time period t1 elapses after the initiation of the rest operation mode, the indoor target humidity is set to a humidity "DM+DC," which higher than the first target humidity DM by a predetermined humidity DC, and the indoor humidity is controlled. The indoor humidity is thereby brought to a higher humidity than in a regular mode when the user wakes up, and sweating in the user is therefore suppressed, as is skin or throat dryness.

Furthermore, the air conditioner 1 controls the indoor temperature so that the indoor temperature decreases in accordance with the decrease in the user's core body temperature when the user is falling asleep, and also so that the lowered indoor temperature is then raised in accordance with the increase in the user's body temperature when the user wakes up. Specifically, when the rest operation mode is set, the air conditioner 1 controls not only the humidity but the temperature as well. The user can thereby be allowed to fall asleep and wake up more comfortably.

The air conditioner 1 also sets the target humidity so as to be within a range (FIG. 5) that is higher than the humidity at which the oral mucous membrane dries up and lower than the humidity at which mold forms. The room interior is thereby maintained at a comfortable humidity level both at the time when the user falls asleep and at the time when the user wakes up.

Conventional air conditioners control based on relative humidity levels. However, the air conditioner 1 of the present embodiment uses absolute humidity as the target humidity and controls based on the absolute humidity, or the relative humidity in a manner equivalent to the absolute humidity, so that the indoor humidity reaches the target humidity. The room interior is thereby brought to a more comfortable humidity level for the user when the user falls asleep or wakes up.

<Other Embodiments>

An embodiment of the present invention was described above, but the present invention is not limited to the above-described embodiment, and various modifications are possible within a range that does not deviate from the scope of the invention.

(a) In the embodiment described above, a case was described in which the air conditioner 1 operated in a rest mode when instructed to initiate the rest operation mode from a remote controller, but the air conditioner may operate in the rest mode as long as other additional conditions are met. An example of another condition is, e.g., a case in which the time from the start of the rest operation mode to the scheduled waking time is three hours or more, for example.

In a case in which the time from the start of the rest operation mode to the scheduled waking time is 3 hours or more but is less than the interval from the end of the predetermined time period t1 to the scheduled waking time (trh in FIG. 5), the air conditioner 1 may set the target humidity to "DM+DC" after the start of the rest operation mode.

(b) When the air conditioner 1 is operating in the rest mode, the air conditioner 1 can control corresponding to a changed scheduled waking time in cases in which the scheduled waking time has been changed by the user, for example.

For example, in cases in which the scheduled waking time is changed to be earlier than the originally set time, the target humidity setting unit 8*d* of the control unit 8 makes earlier the timing of increasing the target humidity in accordance with the changed scheduled waking time. The target temperature setting unit 8*c* also may change the range of reduction, the range of increase, the level of reduction, the timing of increase, and other factors of the target temperature in accordance with the changed scheduled waking time.

In cases in which the scheduled waking time is changed to be later than the originally set time, the target humidity setting unit 8*d* of the control unit 8 makes later the timing of increasing the target humidity in accordance with the changed scheduled waking time. The target temperature setting unit 8*c* also may change the range of reduction, the range of increase, the level of reduction, the timing of increase, and other factors of the target temperature in accordance with the changed scheduled waking time.

(c) In the embodiment described above, a case was described in which the air conditioner 1 ended the operation in the rest mode at the scheduled waking time set by the user, but the operation in the rest mode can be ended with other conditions. An example of another condition is a case in which a "stop" command is received during the rest operation. In such cases, the air conditioner 1 can switch to the operation in the automatic mode, for example.

(d) The air conditioner 1 according to the embodiment described above no longer operates in the rest mode and returns the target temperature and humidity respectively to the normal target temperature and target humidity when the time reaches the scheduled waking time set by the user, but the air conditioner is not limited to this option alone. The air conditioner may also change the target temperature and humidity to a particular stored target temperature and target humidity (e.g., an environment suitable for the activity) after the scheduled waking time has passed.

(e) In the embodiment described above, the target temperature was lowered by approximately 0.5° C. for a user who was falling asleep, and the target temperature was raised by approximately 0.5° C. increments as the time approached the scheduled waking time, but the numerical values are not limited to these options alone. In the embodiment described above, the time intervals at which the target temperature was varied were uniform, but the time intervals need not be uniform. The air conditioner preferably controls so that the target temperature is lowered by a more accurate amount when the user is falling asleep than during normal times, and also so that the target temperature is raised by an appropriate amount when the user is waking from the lowered temperature maintained when the user was falling asleep. The air conditioner is not limited to controlling so that the operation mode maintained when the user is waking is the same as the automatic operation mode or another regular mode.

The air conditioner does not raise the target humidity while controlling for the target temperature to lower in steps, as shown in FIG. 4 of the embodiment described above.

(f) In the embodiment described above, a separated-type air conditioner 1 was described as an example, but the air conditioner is not limited to this option alone. The air conditioner according to the present invention can be applied to, e.g., an air conditioner embedded in a ceiling or the like, or other types of air conditioners.

Industrial Applicability

The present invention has the effect of being able to promote comfortable sleep for the user, and the present invention can be used as an air conditioner.

What is claimed is:

1. An air conditioner having a regular mode and a sleep mode, the air conditioner comprising:

a humidity adjustment unit being configured to humidify or dehumidify air and to supply the air into a room;

a command receive unit being configured to receive operation initiation commands for the regular mode or the sleep mode;

a humidity control unit controlling the humidity adjustment unit so that the indoor humidity reaches a first target humidity when the command receive unit has received a command to initiate the regular mode operation, and controlling the humidity adjustment unit so that the indoor humidity reaches a second target humidity being higher than the first target humidity when a predetermined time period has passed after the command receive unit has received a command to initiate the sleep mode operation;

a temperature adjustment unit that cools or heats air to adjust the indoor temperature, and a temperature control unit that controls the temperature adjustment unit so that the indoor temperature reaches a second target temperature, which is below a first target temperature set during the regular mode, when the command receive unit has received a command to initiate the sleep mode operation, and that controls the temperature adjustment unit so that the indoor temperature reaches the first target temperature when at least the predetermined time period has passed after the command receive unit received the command to initiate the sleep mode operation, wherein the temperature control unit controls the temperature adjustment unit so that the indoor temperature continues to decrease by a first predetermined temperature for each of a plurality of first time intervals and reaches the second target temperature at a first predetermined time after the command receive unit received the command to initiate the sleep mode operation, and subsequently controls the temperature adjustment unit so that the indoor temperature continues to rise by a second predetermined temperature for each of a plurality of second time intervals and reaches the first target temperature at a second predetermined time.

2. The air conditioner according to claim 1 wherein the humidity control unit controls the humidity adjustment unit so that the indoor humidity reaches a third target humidity that is lower than the first target humidity during the predetermined time period.

3. The air conditioner according to claim 2, wherein the second target humidity and the third target humidity are within a range that is higher than the humidity at which the oral mucous membrane dries up and lower than the humidity at which mold forms.

4. The air conditioner according to claim 3, wherein the second target humidity and the third target humidity are absolute humidities.

5. The air conditioner according to claim 1, wherein the humidity adjustment unit has a humidification unit that humidifies air, with the humidity control unit controlling the humidification unit to raise the indoor humidity to the second target humidity.

6. The air conditioner according to claim 5, wherein the humidity control unit controls the humidity adjustment unit so that the indoor humidity reaches a third target humidity that is lower than the first target humidity during the predetermined time period.

7. The air conditioner according to claim 6, wherein the second target humidity and the third target humidity are absolute humidities.

8. The air conditioner according to claim 1, wherein the second target humidity and the third target humidity are absolute humidities.

9. A humidity control method for controlling indoor humidity so that the indoor humidity during a regular mode reaches a first target humidity, the humidity control method comprising:

receiving a command to initiate a sleep mode operation;

dehumidifying or humidifying air and supplying the air into a room so that the indoor humidity reaches a second target humidity being lower than the first target humidity during a predetermined time period after the operation initiation command was received;

humidifying air and supplying the air into the room so that the indoor humidity reaches a third target humidity being higher than the first target humidity, when the predetermined time period has passed after the operation initiation command was received;

adjusting an indoor temperature so that the indoor temperature continues to decrease by a first predetermined temperature for each of a plurality of first time intervals and reaches a second target temperature at a first predetermined time after the operation initiation command was received; and subsequently adjusting the indoor temperature so that the indoor temperature continues to rise by a second predetermined temperature for each of a plurality of second time intervals and reaches a first target temperature at a second predetermined time, the second target temperature being below the first target temperature which is set during the regular mode.

* * * * *